United States Patent [19]
Wilson
[11] 4,441,428
[45] Apr. 10, 1984

[54] CONICAL SHAPED CHARGE LINER OF DEPLETED URANIUM

[76] Inventor: Thomas A. Wilson, 1117 N. Luna Cir., Santa Fe, N. Mex. 87501

[21] Appl. No.: 338,284

[22] Filed: Jan. 11, 1982

[51] Int. Cl.[3] ..... F42B 1/02
[52] U.S. Cl. ..... 102/307; 102/306; 102/476; 102/518; 149/14; 149/15
[58] Field of Search ..... 102/306–310, 102/476, 518, 519, 524; 149/14, 15

[56] References Cited

U.S. PATENT DOCUMENTS

| | | | |
|---|---|---|---|
| 3,302,570 | 2/1967 | Marquardt | 102/519 X |
| 3,750,585 | 8/1973 | Feldman | 102/513 |
| 3,941,057 | 3/1976 | Peterson et al. | 102/518 X |
| 4,015,528 | 4/1977 | Barr | 102/518 |

OTHER PUBLICATIONS

Berthoff et al., *Two dimensional Stress Wave Calculations—*, Energy Research Abstracts ERA 02-052674, (1977).

Bartlett et al., *Radiation Characterization, and Exposure Rate Measurements from Cartridge, 105 MM,* ERA 05-012503, (11/79).

Jackson et al., Processing & Properties of High-purity, Fine-grain Size, depleted Uranium, Deep-drawn Shapes, ERA 06-003925, (10/80).

*Primary Examiner*—Peter A. Nelson

[57] ABSTRACT

This invention relates to a new Blasting Device especially adapted to drilling oil and gas wells, characterized by a shaped charge of explosives, having a liner of depleted uranium.

1 Claim, No Drawings

CONICAL SHAPED CHARGE LINER OF DEPLETED URANIUM

This invention relates to a novel Blasting Device especially adapted to drilling oil and gas wells.

BACKGROUND

Of the many uncertainties facing the oil and gas producer in estimating the cost of his product, drilling cost estimates are the least certain. This is particularly true today and in the future due to the extreme depths at which oil and gas are currently being found (i.e., 18,000 to 25,000 ft.). It is usually true that the deeper the well, the more hard rock that has to be penetrated. It is also true that certain areas of this country that have shown oil and gas producing potential, have been avoided because of the extreme drilling costs insured by the large amount of rock that must be penetrated in order to reach the oil and gas deposits. The "overthrust" region in the western part of the country is an example. Current hard rock penetration rates rarely exceed 10 ft per hour, even when employing the most costly and sophisticated drill bits designed specifically for hard rock. Thus any means by which the penetration rate can be increased is desirable due to the economy of cost and time thus derived. The invention to be described provides such a device, capable of hard rock penetration rates of up to 1,000 ft. per hour!

The invention is embodied in a new type of shaped charge (often referred to as explosives with and without lined cavities) that has extraordinary hard rock penetrating power.

Shaped charges, lined and unlined, have been put to a variety of uses for at least 100 years. Currently, the widest use is in fracturing oil and gas bearing sandstone in order to increase the oil and gas production rates of wells. Therefore our patent application is confined to the new embodiment mentioned above where end use is centered on hard rock penetration. The new type of shaped charge device exhibits hard rock penetration of at least 5 times that of any known shaped charge and as much as 100 times that of current drilling methods.

The objects of the invention are as follows:

The principal object is a novel Blasting Device capable of improved rock penetration. Other objectives will be appreciated from the following detailed description of the invention:

DESCRIPTION

Briefly the invention is a device composed of a cylindrical booster explosive equipped with a detonator. The booster is intimately bound to a cylindrical main charge. At the unbound end of the main charge a cavity in the shape of a cone is formed at the time of casting or pressing. The cavity is filled with a metal liner whose outer dimensions are exactly the same as the inner dimensions of the cavity. In all commercially available shaped charges the metal liner is a common metal such as copper or stainless steel. However, in this invention we use depleted uranium as the metal liner, the advantages of which will be discussed below. However, we note that because all the principles and design parameters for shaped charges are well known and because this invention is concerned with the shaped charge liner, no further discussion of the principles of shaped charge design will be presented except as such a device depends on our new liner and the performance thereof as it relats to the new liner. See G. Birkhoff et al., Journal of Applied Physics, Vol. 19, June 1948, pages 563–582 and "The Science of High Explosives", by M. Cook, Chapter 10, Reinhold Publishing Corp., N.Y., 1958; for the details of shaped charge design, theory and engineering. Considerable historical background on shaped charges is also presented in both of the references.

Table 1 lists selected physical properties of five elements, namely Uranium, Tungsten, Rhenium, Osmium and Iridium, all of which would be candidate metals for the cavity liner based on the mathematical description of penetration which is $$P=l(pi/p)^{\frac{1}{2}}$$

where:

P=penetration in units of distance l=the length of the metal jet $p_i$=density in grams/cm$^3$ of the jet metal p=density in grams/cm$^3$ of the material being penetrated From this expression it can be calculated that if a mean density of 3 grams/cm$^3$ is taken for hard rock and a jet length of 10 centimeter is considered, then with depleted Uranium used as the liner the penetration would be 25.2 centimeters. However, tests show that the penetration of such a Uranium jet is about 87 centimeters, a factor of 3.5 greater than expected and a factor of 5 times that measured for the copper jet and for an iron jet 5.4 times greater.

The explanation of this behavior is based in part on the physical properties of depleted Uranium and in part on the chemical reactivity of depleted uranium. Table 1 is provided as a summary of the physical properties of Uranium and other candidate liner metals; the corresponding physical properties of copper and iron are included for comparison. An interesting feature of the first five entries in the table (i.e., the candidate liner metals) is that depleted Uranium has the lowest melting and boiling points and the lowest heat of fusion, heat vaporization and ionization potential. Thus depleted Uranium is the significant choice for a liner material.

The mechanism of penetration by the metal jet from either iron or copper is plastic deformation, that is, the jet pushes aside the material through which it passes. The material being penetrated by the jet at pressures of up to 300,000 atmospheres of pressure, acts like a fluid and as such is easily deformed. Certainly when depleted uranium is used as the liner metal part of the penetration occurs by way of plastic deformation for the pressures created by the depleted Uranium jet exceed 600,000 atmospheres because of its great density! However, because of the low first ionization potential and the tremendous thermodynamic temperature (to a first approximation 83,000 for 133 milligram jet) a highly reactive depleted Uranium jet is formed that chemically reacts with the material through which the jet passes. The products of the reaction are extraordinary in diversity, however a substantial amount of gaseous depleted Uranium products are formed. Albeit solid products are formed as well, the structure of the target material is disintegrated along the jet's path.

TABLE 1

| Element | Density (gm/cm$^3$) | Melting Point (°C.) | Boiling Point (°C.) | /Kg | Heat of Fusion (Kcal/gm-atom) | Heat of Vaporization (Kcal/gm-atom) | 1st Ionization Potential (eV) |
|---|---|---|---|---|---|---|---|
| Uranium* | 19.07 | 1132 | 3818 | 300— | 2.7 | 110 | 6.08 |
| Tungsten | 19.3 | 3387 | 5927 | 100— | 8.05 | 197 | 7.98 |
| Rhenium | 21.04 | 3180 | 5900 | 1600— | 7.9 | 152 | 7.87 |
| Osmium | 22.06 | 3000 | 5500 | 3,000— | 6.4 | 162 | 8.5 |
| Iridium | 22.65 | 2454 | 5300 | 81,000— | 6.6 | 152 | 9.0 |
| Iron | 7.87 | 1536 | 3000 | 12— | 3.67 | 84.6 | 7.87 |
| Copper | 8.94 | 1083 | 2595 | 20— | 3.1 | 72.8 | 7.80 |

*depleted!

SUMMARY

Depleted Uranium appears to provide an economical solution to hard rock penetration in any case, when used as the liner material for a shaped charge.

I intend to be limited only by the following patent claims:

I claim:

1. A shaped charge Blasting Device comprising a cylindrical charge of detonating explosive, a cavity disposed in one end of said charge, said cavity being in the shape of a cone, and a metal liner disposed in said cavity, said liner comprising depleted uranium.

* * * * *